US005988909A

United States Patent [19]

Luke, Jr. et al.

[11] Patent Number: 5,988,909

[45] Date of Patent: Nov. 23, 1999

[54] WRITING INSTRUMENT WITH ERGONOMIC GRIP

[76] Inventors: Stanley C. Luke, Jr., 31 La France Ave., Bloomfield, N.J. 07003; Victor Luke, 23C Washington Ave., N. Plainfield, N.J. 07060

[21] Appl. No.: 08/789,253

[22] Filed: Jan. 28, 1997

Related U.S. Application Data

[63] Continuation-in-part of application No. 08/424,726, Jun. 27, 1995, abandoned, which is a continuation of application No. 08/801,120, Dec. 2, 1991, abandoned.

[51] Int. Cl.[6] ..... B43K 23/008; B43K 23/012

[52] U.S. Cl. ..... 401/6; 401/88

[58] Field of Search ..... 401/6, 7, 88, 91

[56] References Cited

U.S. PATENT DOCUMENTS

| | | | |
|---|---|---|---|
| H1050 | 5/1992 | Petrillo | 401/6 |
| D. 92,534 | 6/1934 | Hale | 401/6 X |
| D. 338,039 | 8/1993 | Takahashi | 401/6 X |
| D. 338,915 | 8/1993 | Willat | 401/6 X |
| 1,395,793 | 11/1921 | Broschart . | |
| 1,598,873 | 9/1926 | Peterson | 401/6 |
| 1,647,536 | 11/1927 | Miller | 401/6 X |
| 4,283,808 | 8/1981 | Beebe | 401/6 X |
| 5,000,599 | 3/1991 | McCall et al. | 401/6 |

FOREIGN PATENT DOCUMENTS

| | | | |
|---|---|---|---|
| 2674186 | 9/1992 | France | 401/6 |
| 1511325 | 7/1969 | Germany | 401/6 |
| 3406522 | 9/1985 | Germany | 401/6 |
| 115884 | 8/1980 | Japan | 401/6 |
| 5724522 | 5/1982 | Japan | 401/6 |
| 2141295 | 5/1990 | Japan | 401/6 |

*Primary Examiner*—Steven A. Bratlie
*Attorney, Agent, or Firm*—Robert J. Sayfie

[57] ABSTRACT

A writing instrument is disclosed having a tubular shaft. A grip is provided having a contoured surface for facilitating manual gripping of the writing instrument. The grip is axially aligned with, and attached to one end of, the shaft. A marking mechanism is also provide for producing marks. The marking mechanism is, axially aligned with, and has a first end attached to an end of, the grip opposite the shaft.

15 Claims, 7 Drawing Sheets

WRITING INSTRUMENT WITH ERGONOMIC GRIP

RELATED APPLICATION

This application is a continuation in part of U.S. patent application Ser. No. 08/424,726 filed for Stanley C. Luke, Jr. et al on Jun. 27, 1995 now abandoned, which was a continuation of U.S. patent application Ser. No. 08/801,120 filed on Dec. 2, 1991, now abandoned.

FIELD OF THE INVENTION

The present invention relates to writing instruments such as pencils, pens, markers, etc. In particular, the present invention relates to a writing instrument which has an ergonomically designed grip to facilitate manual gripping of the instrument and to reduce fatigue and stress on the wrist and fingers.

BACKGROUND OF THE INVENTION

There are numerous types of manual writing instruments such as fountain pens, ball point pens, mechanical pencils, felt tip markers, etc. Each is typically held in one hand while producing marks on a piece of paper. Herein, a writing instrument is said to have a tubular shaft with a marking mechanism connected to one end of the shaft for producing marks. Examples of marking mechanisms include a pen point (e.g., ball point) connected to a cylindrical ink cartridge which extends in a direction opposite to the pen point within the tubular shaft and a pencil lead (actually a cylindrical graphite stick) having a pencil point at one end thereof for producing marks on a writing surface such as a paper sheet.

In a typical manual grip of a conventional writing instrument, the portion of the shaft of the writing instrument near the marking mechanism is rested on the side of the top knuckle of the third finger. Simultaneously, pressure is applied with the index finger at approximately +120° rotation about the shaft from the middle finger, and with the thumb at approximately −120° rotation about the shaft from the middle finger. Often, in order to produce satisfactory marks, or simply by virtue of the writing style of the operator, heavy pressure is transmitted from the hand gripping the writing instrument to the marking mechanism portion which contacts the writing surface. This tends to transmit strain to the fingers and wrist of the operator, particularly if the writing instrument is used over long periods of time. This strain can also produce callouses in on the fingers, particularly the middle finger.

It is an object of the present invention to overcome the disadvantages of the prior art.

SUMMARY OF THE INVENTION

This and other objects are achieved by the present invention. According to one embodiment, a writing instrument is provided with a tubular shaft and a grip axially aligned with, and attached to one end of, the shaft. A marking mechanism for producing marks, is provided which is axially aligned with, and which has a first end attached to an end of, the grip on an opposite side of the grip from the shaft. The grip has a contoured surface for facilitating manual gripping of the writing instrument. For instance, the grip can have a "dumbbell" shape, i.e., a surface of rotation about an axis which is collinear with the axis of the tubular shaft, with an hour glass cross-section taken in a plane containing the axis of rotation. The upper tabular shaft of the writing mechanism has soft cushioned pads which rest between the upper index and thumb knuckles which will aid in relieving muscle fatigue from your hand. Illustratively, such a dumbbell shaped grip has a minimum radius which is less than the outer radius of the tubular shaft. This provides an ergonomic and comfortable grip which reduces fatigue and strain on the wrist and fingers of the operator.

DETAILED DESCRIPTION OF THE INVENTION

Figure 1:
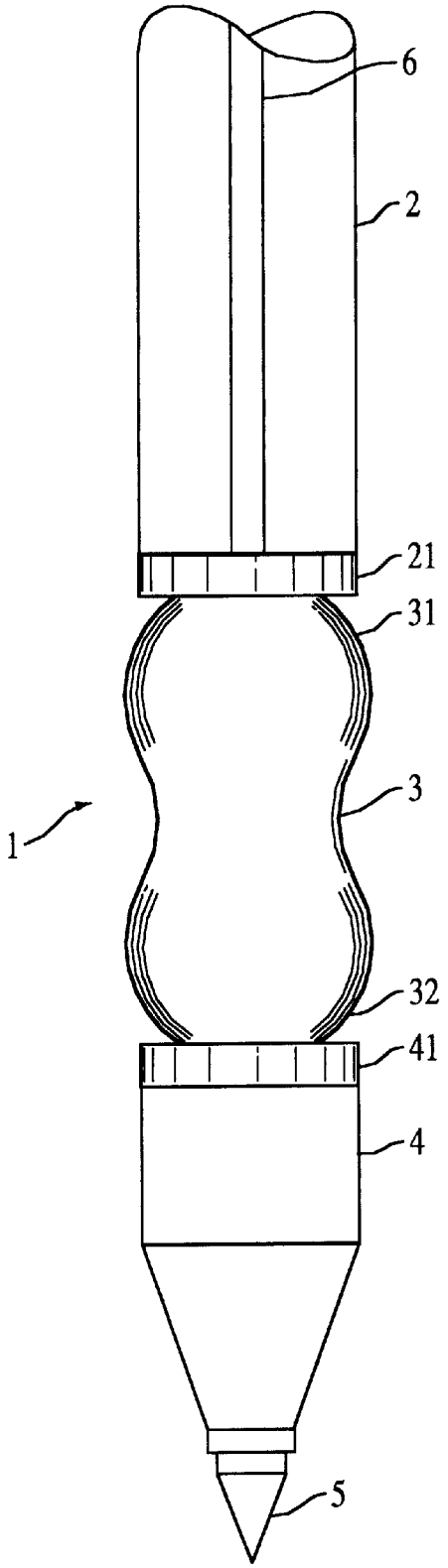
FIG. 1 shows a front view of a writing instrument according to one embodiment of the present invention.
Figure 5:
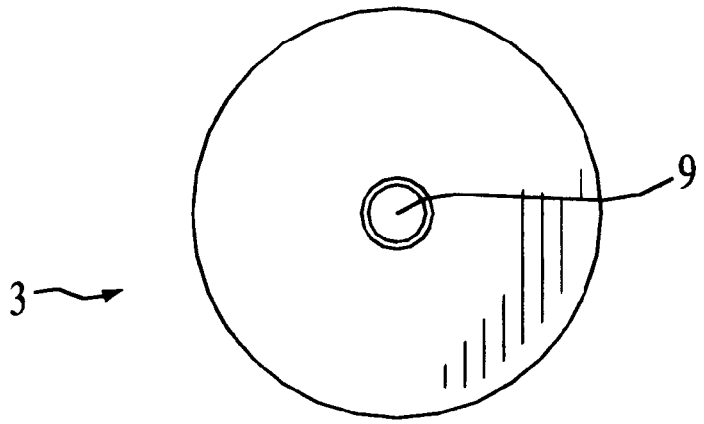
FIG. 5 shows a top side view of the grip of the writing instrument of FIG. 1.
Figure 6:
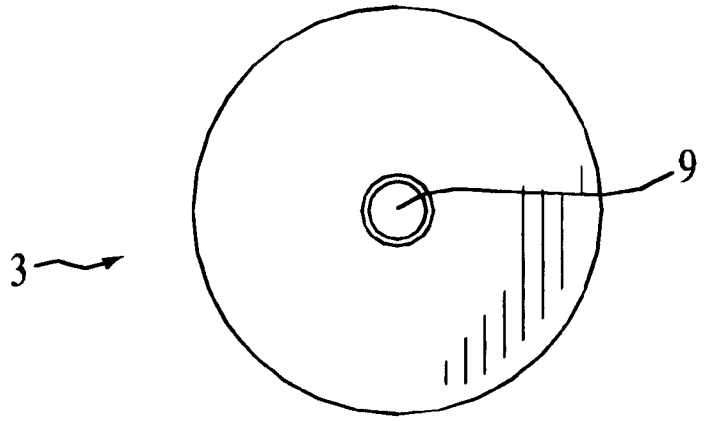
FIG. 6 shows a bottom side view of the grip of the writing instrument of FIG. 1.

FIG. 1 writing instrument 1 according to one embodiment of the present invention. As shown, the writing instrument 1 includes a tubular shaft 2. The tubular shaft is illustratively made of plastic. However, the tubular shaft could be made of other suitable materials commonly used for writing instrument shafts such as wood, metal, etc. A grip 3 is provided which is axially aligned with, and has a first end 31 attached to one end 21 of, the shaft 2. Illustratively, the grip 3 is made of a resilient material such as semi-soft rubber. A marking mechanism 4 is also provided which is axially aligned with, and has a first end 41 attached to a second end 22 of, the grip 2. Thus, the grip 3 is positioned between the shaft 2 and the marking mechanism 4. As shown, the marking mechanism is a hard-tip ink pen marking device, having a hard tip pen point 5 connected to a cylindrical ink cartridge 6 which extends from the end 41 of the marking mechanism through the grip 3 and tubular shaft 1. However, this is merely illustrative. Any type of marking mechanism may be provided such as a mechanical pencil and lead, fountain pen marking mechanism, felt tip marking mechanism, etc. Illustratively, the marching mechanism 5 is made of plastic. As shown in FIGS. 5 and 6, the grip 3 has an axial through-going passage 9 or bore through which the cylinder 6 passes. Illustratively, the bore 9 is large enough to accommodate the cylinder 6 but smaller than the outer diameters of the shaft 2 and marking mechanism 4.

Figure 2:
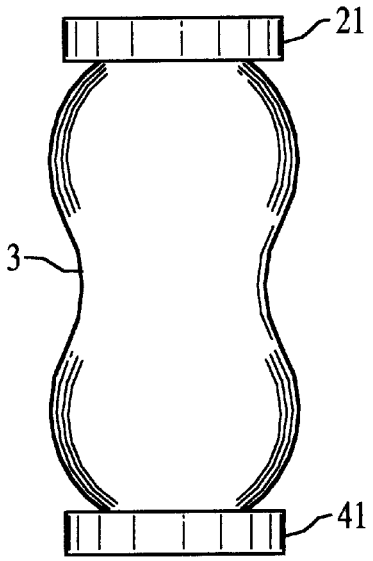
FIG. 2 shows a rear view of the grip of the writing instrument of FIG. 1.
Figure 3:
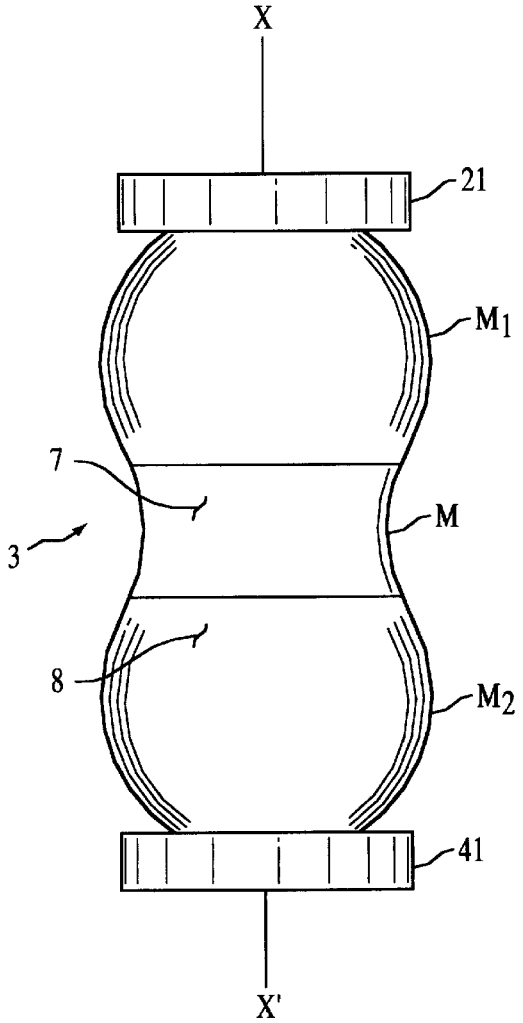
FIG. 3 shows a left side view of the grip of the writing instrument of FIG. 1.
Figure 4:
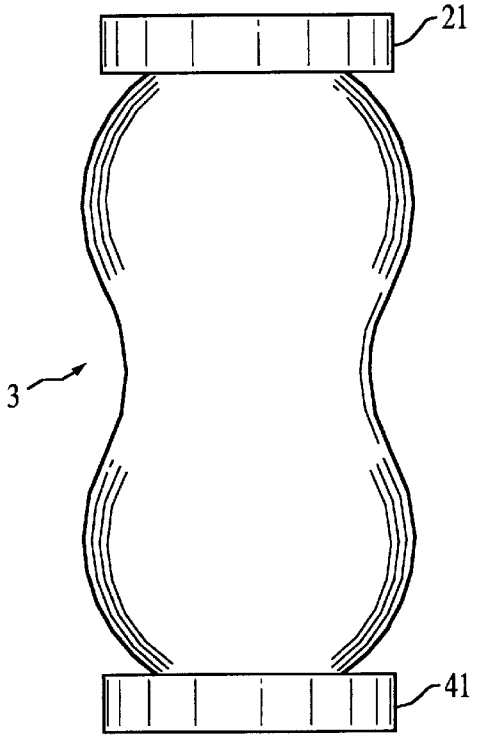
FIG. 4 shows a right side view of the grip of the writing instrument of FIG. 1.

As shown in FIGS. 2–4, the grip 2 has a contoured surface referred to generally by 8. As shown, the surface 8 has a "dumbbell" shape with an "hour-glass" shaped cross-section taken in a plane which contains the axis X-X'. That is, the surface 8 is a surface of rotation formed by rotating a curve C about the axis X-X' (which is collinear with the axes of the tubular shaft 2, grip 3 and marking mechanism 4), which curve C has the minimum m and maximums $M_1$ and $M_2$. The radius of the surface 8 from the axis X-X' in a curved valley 7 in the vicinity of the minimum point m is less than the radius of the tubular shaft 2.

The operation of the writing instrument 1 is similar to the operation of a conventional writing instrument, i.e., the writing instrument 1 is illustratively gripped using the same three fingers. However, unlike the conventional writing instrument, the operator grips the writing instrument 1 with the middle finger, index finger and thumb contacting the grip 3. In particular, the fingers contact the curved valley 7 (FIG. 3) of the surface 8. The grip 3 provides an ergonomical grip which reduces the strain on the fingers and wrist by virtue of the following three cooperating features:

(1) the grip 3 is made of a resilient material, such a semi-soft rubber;

(2) the surface 8 is curved to conform to the shape of the fingers gripping it; and (3) the diameter of the valley 7 is smaller than the diameter of the tubular shaft 2.

Thus, comfort is increased and both wrist tension and finger fatigue are reduced.

Furthermore, the likelihood of the production of callouses on the fingers is reduced.

Figure 7:
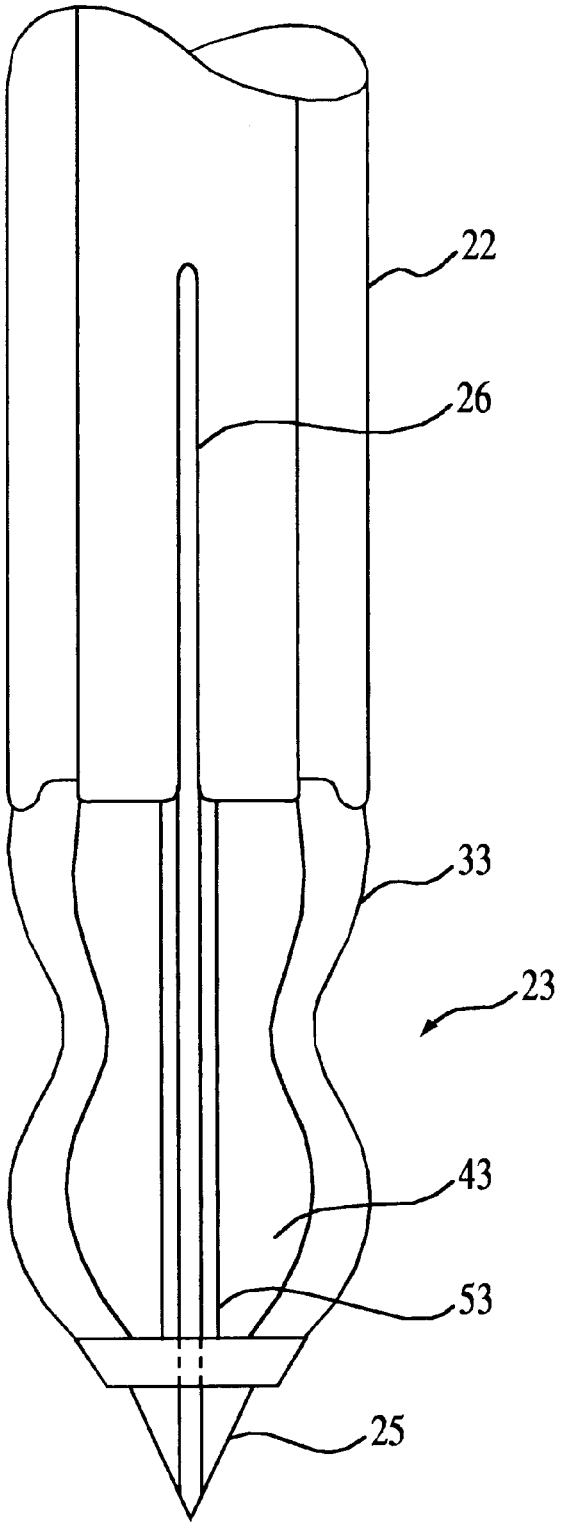
FIG. 7 shows a cross-section of another embodiment of the invention.

Referring to FIG. 7, a writing instrument 21 according to another embodiment of the invention is shown. The writing instrument 21 is illustrated in the context of a pen writing instrument with ink well 26 and pen point 25. As shown, a grip 23 is provided having an outer surface that is integrated with the edge of the shaft 22 and pen point 25. Illustratively, at least the outer surface of the shaft 22 may be made of rubber.

As shown, the grip 23 is formed of at least two axially aligned, surface of rotation layers. A first, outer layer 33 is made of resilient or flexible material such as semi-soft rubber. A second, inner layer 43 is provided within the first outer layer 33 which is made of an even more flexible material than the outer layer 33 such as, foam rubber. As shown, the inner layer 43 illustratively has the same "dumbbell" outer surface shape as the outer layer 33. By providing inner 43 and outer layers 33, the softness of the grip is increased yet the general ergonomic shape of the outer grip surface is maintained while gripping the grip 23.

Illustratively, to further increase comfort, the inner barrel 53 is narrowed. By narrowing the inner barrel 53, the sensation of pressing the fingers against a hard surface within the grip 23 is reduced.

Figure 8:
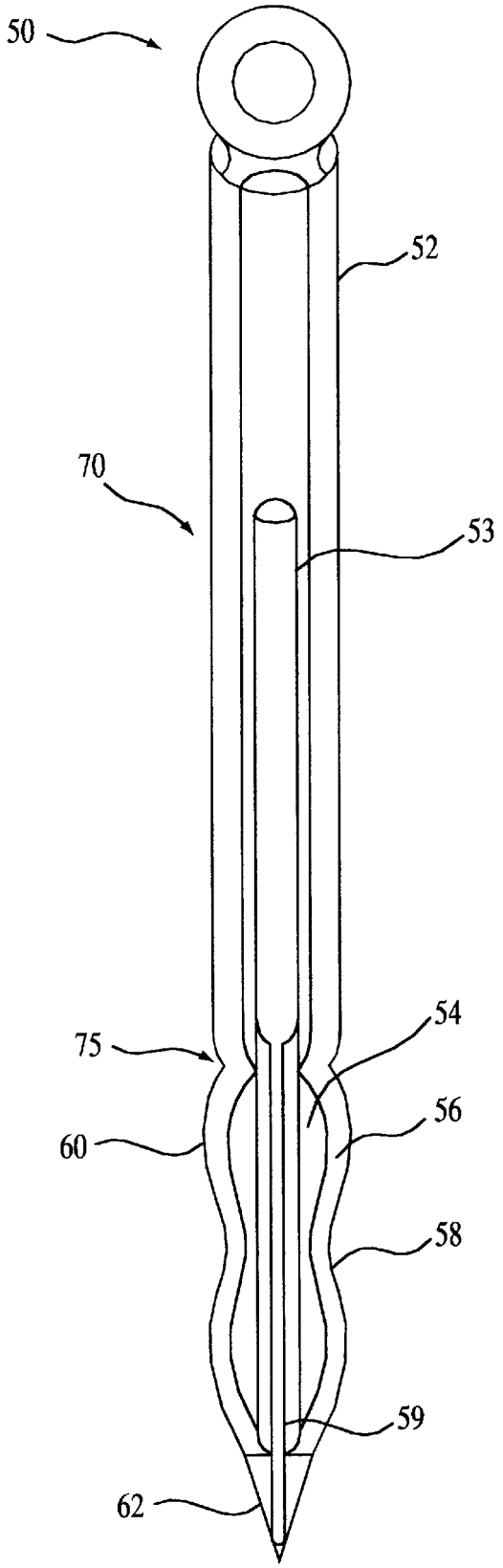
FIG. 8 shows a cross-section of a writing instrument according to one embodiment of the present invention.

Referring to FIG. 8, a writing instrument 50 according to another embodiment of the invention is shown. The writing instrument 50 is illustrated in the form of a pen having an ink cartridge 53. The ink cartridge 53 becomes narrow to form the lower portion 59, which terminates with a pen point 62. At the lower portion of the pen is a grip 60. The grip 60 is comprised of at least 2 layers which are contiguous with each other. The first layer is the inner layer 54 and the second layer is the outer layer 56.

The inner layer 54 is positioned around the lower portion 59 of the ink cartridge 53 which is located within the central cavity of the writing instrument. The inner layer 54 is made of a flexible material that will reform once pressure is released from the grip 60. The inner layer 54 can be made from foam or soft rubber.

The outer layer 56 is superimposed around the inner layer 54 and is contiguous with the inner layer. The outer layer 56 is thicker than the inner layer and is made of a material that is less flexible than the material used to make the inner layer. The outer surface of the tubular shaft 70 is integral with the outer layer 56 of grip 60 at point 75 to form a continuous outer layer 65. This continuous outer layer 65 acts as both a protective cover and additional cushioning. The interaction between the outer and inner layers of the grip result in a unique cushion that is ergonomically superior and which is soft in the inside but durable on the outside.

The lower grip 60 is coextensive with a tubular shaft 70. Attached to the outer surface of the tubular shaft 70 is a multiplicity of cushioned pads 52. The cushioned pads 52 may be enclosed in the continuous outer layer 65. This design cushions the tubular shaft as it rests on the writer's hand and therefore reduces muscle fatigue when writing.

Figure 9:
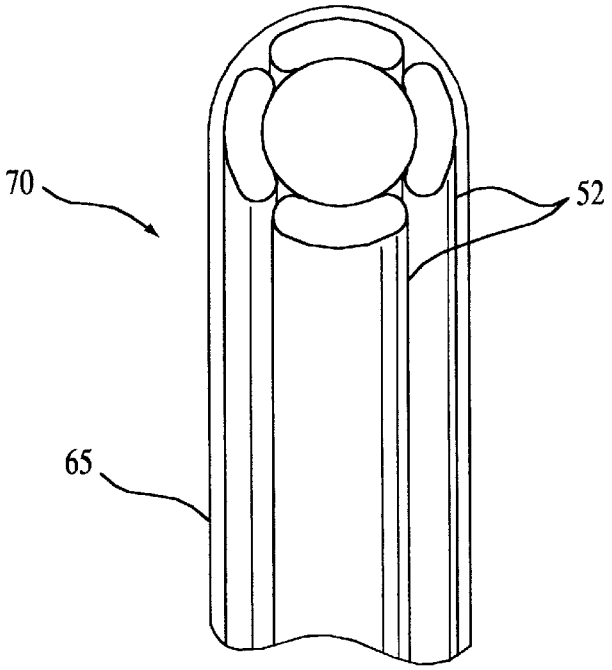
FIG. 9 shows a front view of the tubular shaft of the writing instrument of FIG. 8.

The pads are further shown in FIG. 9. FIG. 9 illustrates the upper shaft 70 in which pads 52 are enclosed to the continuous outer layer 65. The soft cushioned pads have been found to be preferably 2/16–3/16 inches thick (i.e., foam of soft rubber) to provide adequate cushioning without being too thick to be uncomfortable for the user.

Figure 10:
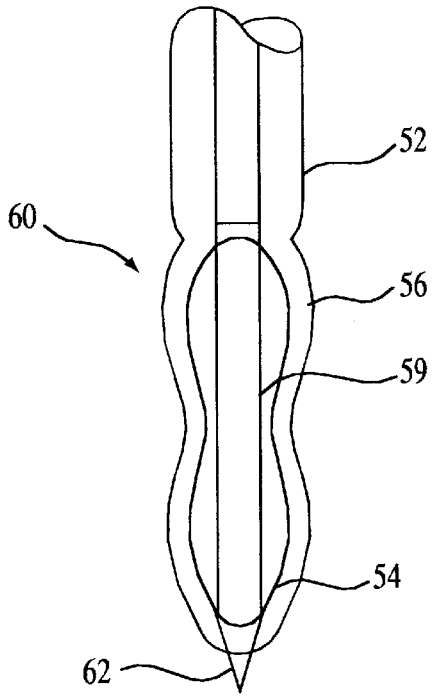
FIG. 10 shows a cross-section of the grip of the writing instrument of FIG. 8.

FIG. 10 shows the lower portion of the writing mechanism. In FIG. 10 the outer layer 56 of the lower portion 80 is made of a thick moderately flexible material, such as polyurethane or soft rubber. As stated above, this material is less flexible than the material used for the inner layer of the lower portion. The inner layer 54 of the lower portion 80 is preferably about 2/16–3/16 inches thick and is more flexible than the outer layer. The "dumbbell" or "Figure 8" shape of the lower grip has a waist that is flanked by upper and lower bulging portions. This shape provides a resting surface for the writer's fingers.

When the lower portion 80 of the grip is depressed the inner layer 54 squeezes inward towards the ink cartridge like a sponge. When this pressure is released, the inner layer 54 and outer layers will reform back to their normal shape. The double-layer structure comprising of at least two different degrees of flexibility prevents fatigue and muscle stress within the fingers and hand. This arrangement also serves as a protective cushion from feeling the hardness of the narrow inner barrel 59.

Figure 11:
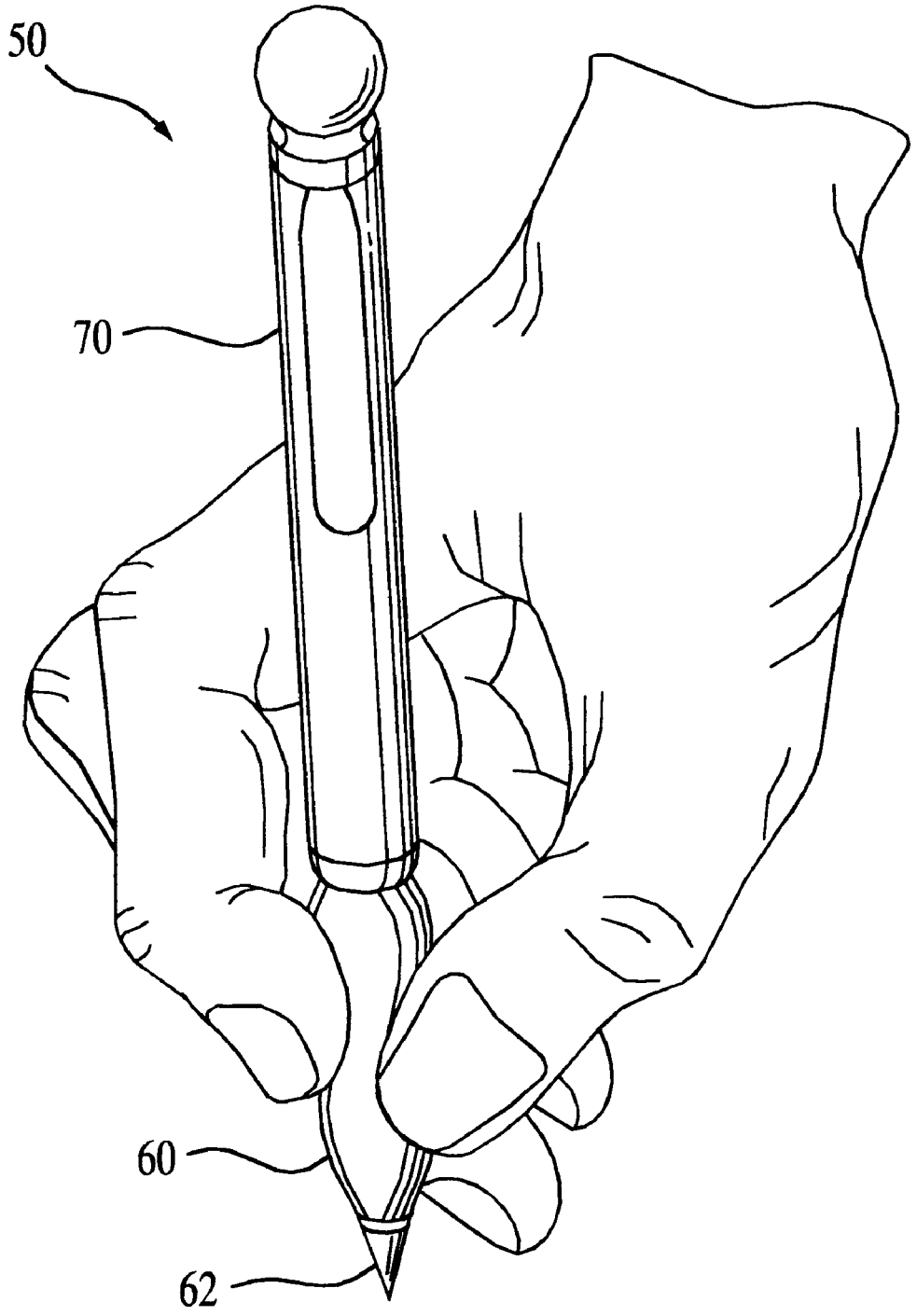
FIG. 11 shows a front view of the writing instrument according to FIG. 8 positioned in the hand of a writer.

FIG. 11 shows the writing mechanism 50 in use. This figure illustrates the writing mechanism positioned in the hand of the writer. As shown, the thumb rests on the lower portion 80 of the "dumbbell" shaped grip and the index finger wraps around the writing mechanism to rest on the lower portion 80, opposite the thumb. The padded upper shaft 52 rest against the crotch portion of the hand below the knuckles providing additional comfort when resting against the hand.

Finally, the invention has been described above with reference to specific embodiments. However, this was merely illustrative. Numerous alternative embodiments may be devised without departing from the spirit and scope of the following claims.

The claimed invention is:

1. A writing instrument comprising:

a tubular shaft, a plurality of pads positioned on an outer surface of said tubular shaft, a grip having a contoured shape attached to one end of said tubular shaft, said contour shape having two bulging portions and a narrow waist positioned between said bulging portions, said grip having an inner and outer layer, whereby said grip is integral with said outer surface of said tubular shaft, said outer layer being constructed of flexible material whereby providing a cushioned surface, a marking mechanism for producing marks, axially aligned with and attached to one end of said shaft having a first end attached to an end of said grip opposite said shaft.

2. The writing instrument of claim 1 wherein said outer layer is at least about 2/16 of an inch whereby providing both a protective covering and a cushioned surface and said inner layer being more flexible and thinner than said outer surface.

3. The writing instrument of claim 1, wherein said pads are made of foam or soft rubber and are attached to said outer surface as elongated panels.

4. The writing instrument of claim 1, wherein said outer layer of said grip is made of a thick flexible rubber and said inner layer of said grip is made of a less flexible layer whereby both layers provide a cushioned grip.

5. The writing instrument of claim 1, wherein the grip is about at least 1½ inches in length.

6. The writing instrument of claim 1, wherein said outer layer of said grip is made of rubber and is at least about 2/16 inches thick.

7. The writing instrument of claim 1, wherein said marking mechanism includes a pen point.

8. The writing instrument of claim 1, wherein said marking mechanism includes a pencil point.

9. The writing instrument of claim 1, wherein said grip is dumbbell shaped having a waist flanked with an upper and a lower bulging portion, said upper and lower bulging portions providing a cushioned surface area for the placement of fingers when writing.

10. The writing instrument of claim 1, wherein said grip comprises a bore axially aligned with an axis of said tubular shaft and wherein said marking mechanism further comprises a cylindrical element extending through said bore of said grip.

11. The writing instrument of claim 10 wherein said cylindrical element contains ink.

12. The writing instrument of claim 10 wherein said cylindrical element is a pencil lead.

13. A writing instrument comprising:

a tubular shaft, a plurality of pads positioned on an outer surface of said tubular shaft, a grip having a contoured shape attached to an end of said tubular shaft, said contour shape having two bulging portions and a narrow waist positioned between said bulging portions, said grip having an inner and outer layer, said outer layer being constructed of flexible material having a greater thickness then the inner layer whereby providing both a protective covering and a cushioned surface, said inner layer being more flexible and thinner than said outer surface, a marking mechanism for producing marks, axially aligned with and attached to one end of said shaft having a first end attached to an end of said grip opposite said shaft.

14. The writing instrument of claim 13, wherein said pads of said tubular shaft are about at least about 2/16 inches thick.

15. The writing instrument of claim 13, wherein said grip is dumbbell shaped having a waist flanked with an upper and a lower bulging portion, said upper and lower bulging portions providing a cushioned surface area for the placement of fingers when writing.

* * * * *